US010815116B2

(12) United States Patent
Qiu et al.

(10) Patent No.: US 10,815,116 B2
(45) Date of Patent: Oct. 27, 2020

(54) DRAFT BEER MACHINE

(71) Applicants: Diqing Qiu, Taizhou (CN); Dilin Qiu, Taizhou (CN)

(72) Inventors: Diqing Qiu, Taizhou (CN); Dilin Qiu, Taizhou (CN)

(73) Assignee: Talos Technology Corporation, Yuhuan (CN)

( * ) Notice: Subject to any disclaimer, the term of this patent is extended or adjusted under 35 U.S.C. 154(b) by 518 days.

(21) Appl. No.: 15/418,677

(22) Filed: Jan. 28, 2017

(65) Prior Publication Data

US 2018/0099853 A1 Apr. 12, 2018

(30) Foreign Application Priority Data

Oct. 11, 2016 (CN) ..... 2016 1 0887329

(51) Int. Cl.
*B67D 1/08* (2006.01)
*F25D 31/00* (2006.01)
(Continued)

(52) U.S. Cl.
CPC ..... *B67D 1/0868* (2013.01); *B67D 1/0004* (2013.01); *B67D 1/0858* (2013.01);
(Continued)

(58) Field of Classification Search
CPC ..... F25D 31/002; F25D 31/006; F25D 11/00; F25D 29/00; F25D 2400/28; F25D 2700/12; F25D 2700/16; B67D 1/0004; B67D 1/06; B67D 1/0858; B67D 1/0865; B67D 1/0867; B67D 1/0868; B67D 1/0884; B67D 1/0891; B67D 1/0857; B67D 2001/0089
(Continued)

(56) References Cited

U.S. PATENT DOCUMENTS 2,063,002 A * 12/1936 Smith ..... F25D 31/002 222/146.6
2,317,484 A * 4/1943 Richmond ..... F25D 31/002 62/223
(Continued)

FOREIGN PATENT DOCUMENTS

CN 2306223 Y 2/1999
CN 201322507 Y 10/2009
WO WO2006103566 A2 10/2006

*Primary Examiner* — Joseph F Trpisovsky
(74) *Attorney, Agent, or Firm* — Minder Law Group; Willy H. Wong

(57) ABSTRACT

A draft beer machine comprising a cabinet and a refrigeration circuit inside the cabinet, including a compressor, a condenser, and refrigeration tubes. Beer pipes are also arranged inside the cabinet and a beer tap is fixed to the outside of the cabinet. The outer end of the beer pipes is connected to the beer tap. The refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylinder, in an abreast and helical manner. In the same mixing layer, the adjacent beer pipe and refrigeration tube adhere to each other. The adjacent two mixing layers directly adhere or a thermal conductive medium is filled in between the two layers.

20 Claims, 11 Drawing Sheets

(51) Int. Cl.
*B67D 1/00* (2006.01)
*F25D 11/00* (2006.01)

(52) U.S. Cl.
CPC ..... *B67D 1/0891* (2013.01); *F25D 11/00* (2013.01); *F25D 31/002* (2013.01); *B67D 2210/00049* (2013.01); *B67D 2210/00133* (2013.01); *F25D 2400/28* (2013.01)

(58) Field of Classification Search
USPC ..... 62/396
See application file for complete search history.

(56) References Cited

U.S. PATENT DOCUMENTS

| | | | | |
|---|---|---|---|---|
| 2,682,160 | A * | 6/1954 | Kromer | F25D 31/002 62/177 |
| 4,448,036 | A | 5/1984 | Iannelli | |
| 4,462,220 | A * | 7/1984 | Iannelli | B67D 1/06 165/163 |
| 6,553,782 | B1 | 4/2003 | Kyees | |
| 2004/0080220 | A1 * | 4/2004 | Yamamoto | H02K 5/20 310/64 |
| 2005/0028964 | A1 | 2/2005 | Cleland | |

* cited by examiner

DRAFT BEER MACHINE

RELATED APPLICATIONS

This application claims benefit of Chinese Patent Application No. CN 201610887329.3, filed Oct. 11, 2016.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of beverage equipment, and particularly to a draft beer machine.

Related Art

With the progress of the times, and the improvement of people's quality of life, people have a higher requirement for drinking beer. It has been difficult for canned or bottled beer to meet people's drink demand, and more and more people hope they could drink fresh, hygiene, palatable and pure draft beer. A draft beer machine is a device to cool the beer. Traditional draft beer machines are used in coordination with the carbon dioxide cylinder and casks. Beer at normal temperature is stored in the casks, and by applying the pressure from the carbon dioxide cylinder, the beer in the cask will be pressed out and flows into the draft beer machine. The draft beer machine will refrigerate the beer passing through it, and then beer flows out of the draft beer machine and arrives at the tap. People drink beer as soon as they open the tap.

One prior art device comprises a gas cylinder, a water purification device, a cleaning tank, a beer cask, a refrigeration system, a heat exchanger and a beer dispensing section. The gas cylinder is connected to the intake valve pipe of the cleaning tank, the gas cylinder is connected to the intake valve pipe of the beer cask, the water purification equipment is connected to the reversing valve pipe of the cleaning tank, and the reversing valve of the cleaning tank is connected to the reversing valve pipe of the beer cask. The reversing valve of the beer cask is connected to the heat exchanger pipe, the heat exchanger is connected to the pipe of the beer dispensing section, and the heat exchanger is placed inside the refrigeration system. This draft beer machine organically combines the cleaning management and refrigeration, and achieves refrigeration and cleaning quickly. This not only ensures the beer is cool, but also and more importantly ensures the freshness.

Although this draft beer machine can achieve the refrigeration of beer, it has the disadvantage of slow refrigeration speed. Specifically, this draft beer machine cools the water in the water tank by the compressor, and the beer pipe is located inside the water tank. Therefore, when beer passes through the beer pipe, it is cooled. Because it takes some time for the temperature of the water in the water tank to drop, when the draft beer machine is switched on, the discharged beer has not been cooled yet in fact. Therefore, it does not achieve a quick cool in the draft beer machine.

SUMMARY OF THE INVENTION

One objective of one embodiment of the present invention is to avoid the issues stated above in the prior art, and to provide a draft beer machine. The technical issue to be resolved by the present invention is how to provide a draft beer machine with high refrigeration efficiency.

The objective of one embodiment of the present invention can be achieved by the following technical proposal:

A draft beer machine comprises a cabinet, and there is a refrigeration circuit inside the cabinet, including a compressor, a condenser and refrigeration tubes. Beer pipes are also arranged inside the cabinet, and a beer tap is fixed to the outside of the cabinet. The outer end of the beer pipes is connected to the beer tap. It is characterized in that:

The refrigeration tube and the beer pipe are wound into a quick cooler of a round or an elliptic cylindrical shape, in a helical manner. The quick cooler comprises at least one mixing layer, which is formed by winding the refrigeration tube and the beer pipe into a round or elliptic cylinder, in an abreast and helical manner. In the same mixing layer, the adjacent beer pipe and refrigeration tube adheres to each other. The adjacent two mixing layers directly adhere or a thermal conductive medium is filled in between the two layers.

The draft beer machine has a refrigeration circuit, and achieves the refrigeration of beer in the beer pipe by the refrigeration circuit. The refrigeration circuit comprises conventional refrigeration units like a compressor, a condenser, a radiator, etc. The refrigeration units are connected to refrigeration tubes, and can continuously transfer cooling capacity to the refrigeration tubes. There is a beer tap connected to the outside of the cabinet, and the discharge of beer is controlled by the beer tap. In one embodiment of the present invention, the refrigeration tubes and the beer pipes are wound in a helical manner to form a quick cooler. It is ensured that the two of them, in an abreast and helical manner, are wound into at least one layer of mixing layer. Through the close adherence between the refrigeration tubes and the beer pipes, then, the cooling capacity is transferred between the refrigeration tubes and the beer pipes in the form of dry contact cooling. Also, compared to water cooling, dry contact cooling has an advantage of high efficiency of cooling capacity transfer, and can further expedite the refrigeration process to achieve a quick cooling effect, so as to fulfill the purpose of quick cooling of beer. Both of the quick cooler and the mixing layer may be round or elliptic cylindrical. Both shapes can present smooth flow transport everywhere on the refrigeration tubes and the beer pipes. This ensures that the fluid in the beer pipes and the refrigeration tubes flows fluently, can further ensure a uniform distribution of cooling capacity to improve the refrigeration efficiency, and prevents the tubes from being clogged by ice due to non-uniform local cooling capacity. The two adjacent layers directly adhere to each other, so the left side, the right side, the upper side, and the lower side of almost all beer pipes can adhere the refrigeration tubes and are enclosed inside the refrigeration tubes. This ensures a good refrigeration effect. Of course, a thermal conductive medium may be filled in between the two adjacent mixing layers, which can further expedite the efficiency of cooling capacity transfer and improves the refrigeration efficiency.

In the draft beer machine, a refrigeration layer is arranged inside the innermost mixing layer. The refrigeration layer is formed by winding the refrigeration tubes into a round or elliptic cylinder, in a helical manner. The refrigeration layer and the innermost mixing layer directly adhere or a thermal conductive medium is filled in between the two layers. In the present invention, the quick cooler is formed by wrapping several cylindrical mixing layers, so a cylinder-like cavity is formed inside the innermost mixing layer. This cavity is the core of the whole quick cooler, and much cooling capacity gathers here. By arranging a refrigeration layer, which is formed only by refrigeration tubes, inside the innermost mixing layer, the refrigeration fluid in the refrigeration tubes can fully absorb the cooling capacity inside the cavity to store cooling capacity. This avoids waste of cooling capacity, and transfers cooling capacity to beer through the refrigeration fluid, so as to fulfill the purpose of improving the refrigeration efficiency of beer. In addition, this refrigeration layer can ensure that the refrigeration tubes exist on the left side, the right side, the upper side, and the lower side of the beer pipe in the innermost mixing layer. This achieves refrigeration in all directions and ensures the refrigeration efficiency. The refrigeration layer is arranged in a round or an elliptic cylindrical shape, presenting smooth flow transport everywhere on the refrigeration tubes. This ensures that the fluid in the refrigeration tubes flows fluently, prevents the tubes from being clogged by ice due to non-uniform local cooling capacity and ensures a uniform distribution of cooling capacity to improve the refrigeration efficiency. The refrigeration layer and the innermost mixing layer directly adhere or a thermal conductive medium may be filled in between them, which can further expedite the efficiency of cooling capacity transfer and improves the refrigeration efficiency.

In the draft beer machine, a beer pipe layer is sleeved over the outside of the outermost mixing layer. The beer pipe layer is formed by winding the beer pipes into a round or elliptic cylinder, in a helical manner. The beer pipe layer and the outermost mixing layer directly adhere or a thermal conductive medium is filled in between the two layers. When a beer pipe layer is sleeved over the outside of the outermost mixing layer, the beer pipe layer can further prevents cooling capacity in its inner mixing layer from dissipating, and can ensure that the refrigeration fluid always has a low temperature, so as to achieve the quick refrigeration of beer. The beer pipe layer and the outermost mixing layer directly adhere or a thermal conductive medium may be filled in between them, which can further expedite the efficiency of cooling capacity transfer and improves the refrigeration efficiency.

In the draft beer machine, the quick cooler is formed by winding one refrigeration tube and at least two beer pipes. Each beer pipe is wound into each mixing layer continuously. Each beer pipe is successively wound into each mixing layer, so each beer pipe will be gradually refrigerated when passing each mixing layer. This ensures a long refrigeration route, and hence improves the refrigeration effect.

In the draft beer machine, each beer pipe is wound into the beer pipe layer. All beer pipes are wound into the beer pipe layer, which can ensure that the outermost beer pipe layer of the whole quick cooler achieves a good effect of sealing and cooling capacity storage for its interior mixing layer. This can fully take advantage of the residual cooling capacity in the mixing layer, prevents too much cooling capacity from dissipating to the outside of the quick cooler, and further improves the refrigeration effect.

In the draft beer machine, the beer pipe of the innermost mixing layer is used to connect to the cask, and the beer pipe of the beer pipe layer is connected to the beer tap. The refrigeration tube of the outermost mixing layer is connected to the condenser, and the refrigeration tube of the refrigeration layer is connected to the compressor. The refrigeration fluid which outflows from the condenser has a fairly low initial temperature. Namely, the end connected to the condenser is the inlet end of the refrigeration tube. In the present invention, the refrigeration tube in the outermost mixing layer is connected to the condenser, ensuring that the temperature in the outermost mixing layer is always fairly low. Namely, the inlet end of the refrigeration fluid in the quick cooler is located in the outermost mixing layer, and the outlet end is located in the innermost refrigeration layer of the whole quick cooler. Also, the inlet end of beer in the present invention is located in the innermost mixing layer, and the outlet end is located in the outermost beer pipe layer of the whole quick cooler. Therefore, the outlet end of beer is next to the inlet end of the refrigeration fluid, and the inlet end of beer is next to the outlet end of the refrigeration fluid. Beer and the refrigeration fluid form a relative counter-flow formation, ensuring that the outlet end of beer can always indirectly adhere to the refrigeration fluid with low cold. Namely, beer at this place has a fairly low temperature and this further improves the refrigeration efficiency of discharged beer.

In the draft beer machine, the quick cooler is formed by winding one refrigeration tube and one beer pipe. Of course, the quick cooler may also be formed by winding one beer pipe and one refrigeration tube. The refrigeration tube adheres both sides of each beer pipe inside the wound helical coil. The refrigeration effect is better.

In the draft beer machine, the thermal conductive medium is thermal conductive mud or aluminum powder. The thermal conductive mud can be kneaded into various shapes as required, and be filled in between two adjacent tube layers. This allows two tube layers to adhere tightly, reduces the thermal resistance and transfers cooling capacity quickly and effectively to refrigerate beer, so as to improve the refrigeration efficiency of beer. Aluminum powder has a fairly good thermal conductivity and it can effectively transfer cooling capacity, so it is applicable to this situation.

In the draft beer machine, a shell used to accommodate the quick cooler is arranged outside the quick cooler. The quick cooler is located inside the shell, and an insulation layer is set up between the quick cooler and the inner wall of the shell. By arranging a shell and placing the quick cooler in the shell, the dissipation of cooling capacity is further prevented, and it is ensured that much cooling capacity gathers in the shell and gets fully utilized. Also, the arrangement of the insulation layer can enhance the effect of insulation and cooling capacity storage and prevents cooling capacity from further dissipating, so as to further improve the refrigeration effect.

In the draft beer machine, there is a cold storage chamber inside the cabinet, used to hold the cask. The cold storage chamber has a single chamber structure, and the quick cooler is located in the cold storage chamber. The existing draft beer machines generally have a dual cavity structure. The cavity to hold the cask is separated from the cavity used for refrigeration. For example, the refrigeration cavity used for water tank refrigeration is separated from the cavity to hold the cask. Therefore, the excessive cooling capacity in the water tank cannot be fully utilized and hence the cooling capacity is wasted. However, in the present invention, by changing the structure, the whole draft beer machine is designed as a single cavity structure. The cask and refrigeration units like condenser and etc. are all arranged inside the cold storage chamber. Cooling capacity which is not fully absorbed and utilized yet by the quick cooler can disperse to the residual cavity of the cold storage chamber, and reduces the overall temperature of the cold storage chamber. It can refrigerate the cask placed in the cold storage chamber, improves the overall utilization of cooling capacity, and further improves the refrigeration efficiency.

Compared to the prior art, one embodiment of the present draft beer machine has the following advantages:

1. The refrigeration tubes and the beer pipes are wound in a helical manner to form a quick cooler. It is ensured that the two of them, in an abreast and helical manner, are wound into at least one layer of mixing layer. Through the close adherence between the two, then, the cooling capacity is transferred between them in the form of dry contact cooling. Also, compared to water cooling, dry contact cooling has an advantage of high efficiency of cooling capacity transfer, and can further expedite the refrigeration process to achieve a quick cooling function, so as to fulfill the purpose of quick cooling of beer.

2. By arranging the quick cooler and the mixing layers in a round or an elliptic cylindrical shape, smooth flow transport everywhere are presented on the refrigeration tubes and the beer pipes. This ensures that the fluid in the beer pipes and the refrigeration tubes flows fluently, can further ensure a uniform distribution of cooling capacity to improve the refrigeration efficiency, and prevents the tubes from being clogged by ice due to non-uniform local cooling capacity.

3. The two adjacent tube layers directly adhere or a thermal conductive medium may be filled in between two adjacent tube layers, which can further expedite the efficiency of cooling capacity transfer and improves the refrigeration efficiency.

DETAILED DESCRIPTION OF THE INVENTION

Figure 1:
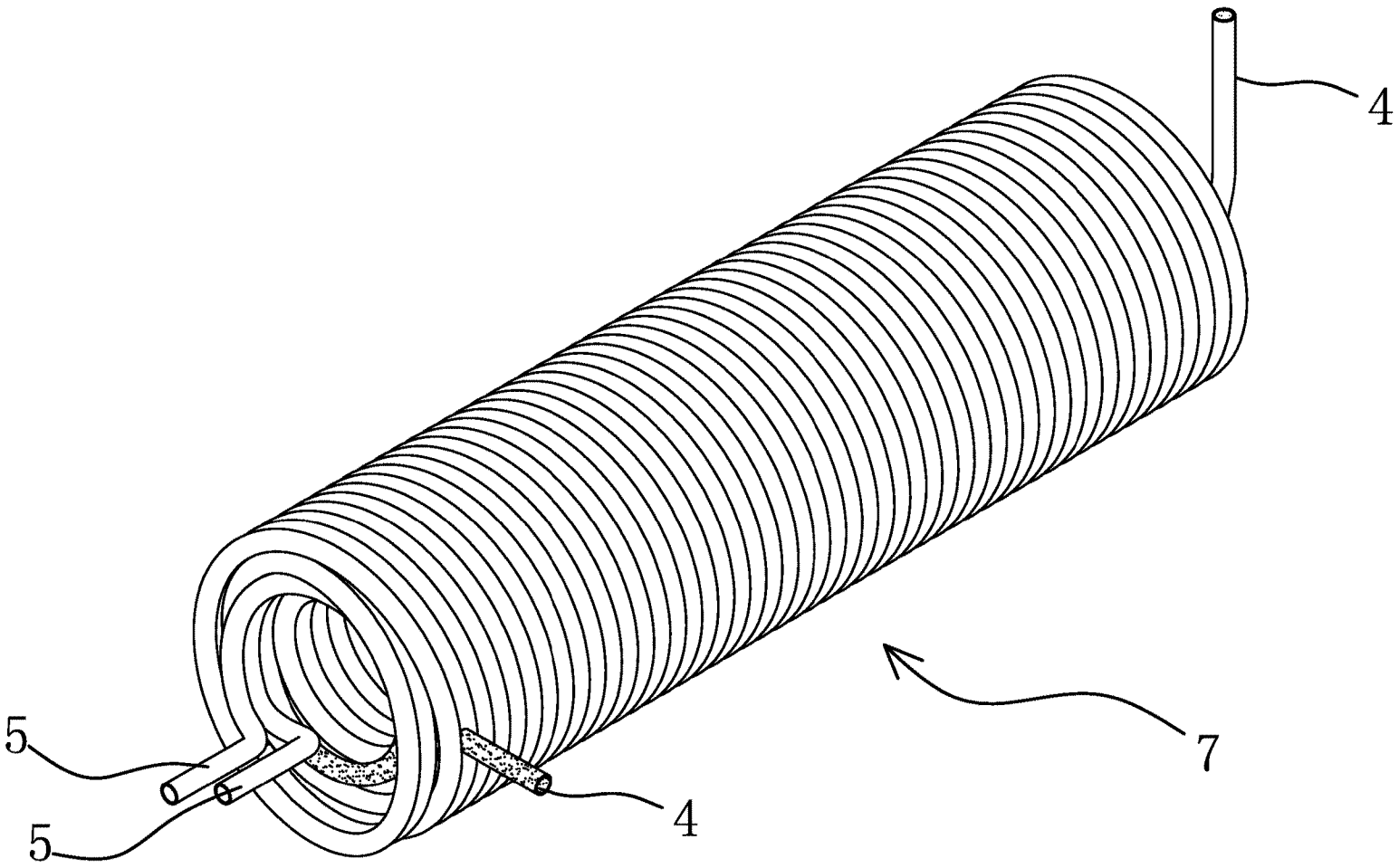
FIG. 1 is a perspective view of the quick cooler of the First Embodiment.

The embodiments of this invention will be described below and the technical solutions of the invention will be further illustrated in connection with the accompanying figures. However, the present invention shall not be limited to these embodiments.

First Embodiment

As shown in FIG. 1 through FIG. 9, one embodiment of a draft beer machine comprises a cabinet (1). The cabinet (1) is overall in a cube shape, and inside the cabinet (1), there is a cold storage chamber (11) used to hold casks (10). A door (12) is also arranged on the cabinet (1) to open or close it conveniently. The cold storage chamber (11) has a single cavity structure, and a refrigeration circuit is arranged inside the cold storage chamber (11). The refrigeration of beer in the beer pipe (5) is achieved by the refrigeration circuit. The refrigeration circuit comprises conventional refrigeration units like a compressor (2), a condenser (3), etc. These refrigeration units are connected to a quick cooler (7) formed by winding refrigeration tubes (4), and can continuously transfer cooling capacity to the refrigeration tubes (4). There are also beer pipes (5) arranged in the cabinet (1). There is a beer tap (6) connected to the outside of the cabinet (1). The outer end of the beer pipes (5) are connected to the beer tap (6), and the discharge of beer is controlled by the beer tap (6). Further, conventional refrigeration unit also includes an evaporator (9), the evaporator (9) is series connected or parallel connected with the quick cooler (7) to form double refrigeration.

Figure 2:
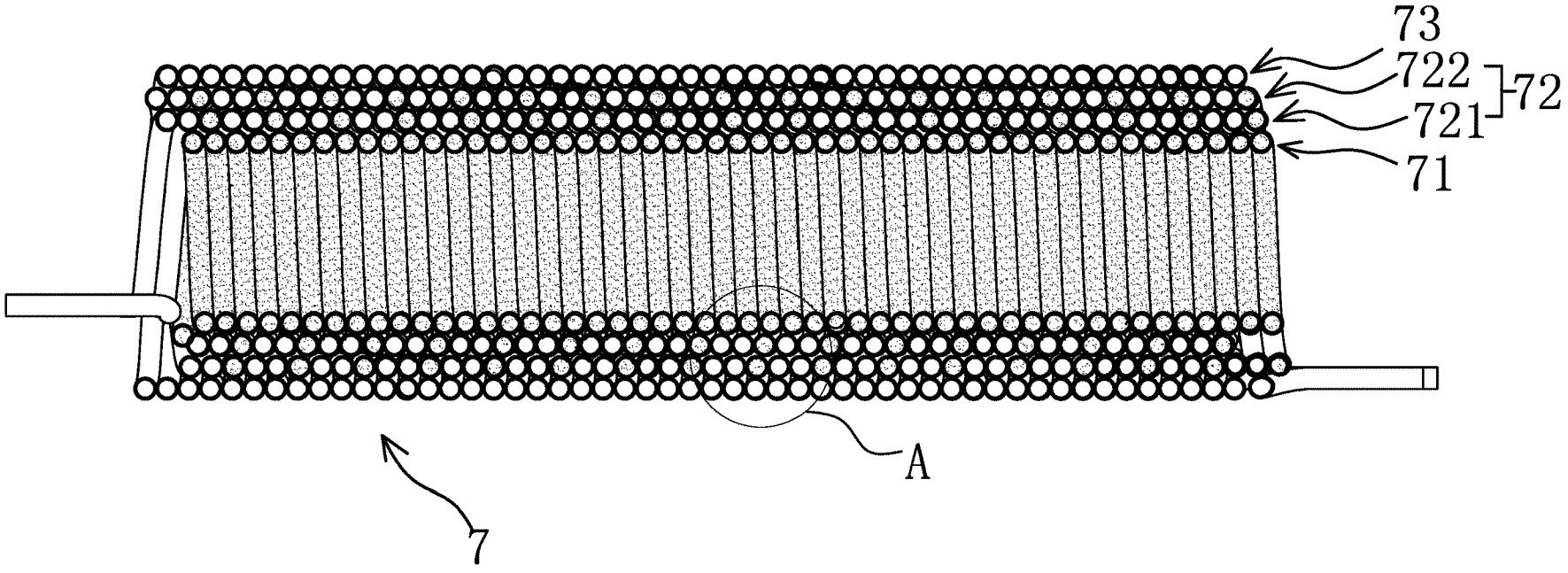
FIG. 2 is a sectional view of FIG. 1.
Figure 3:
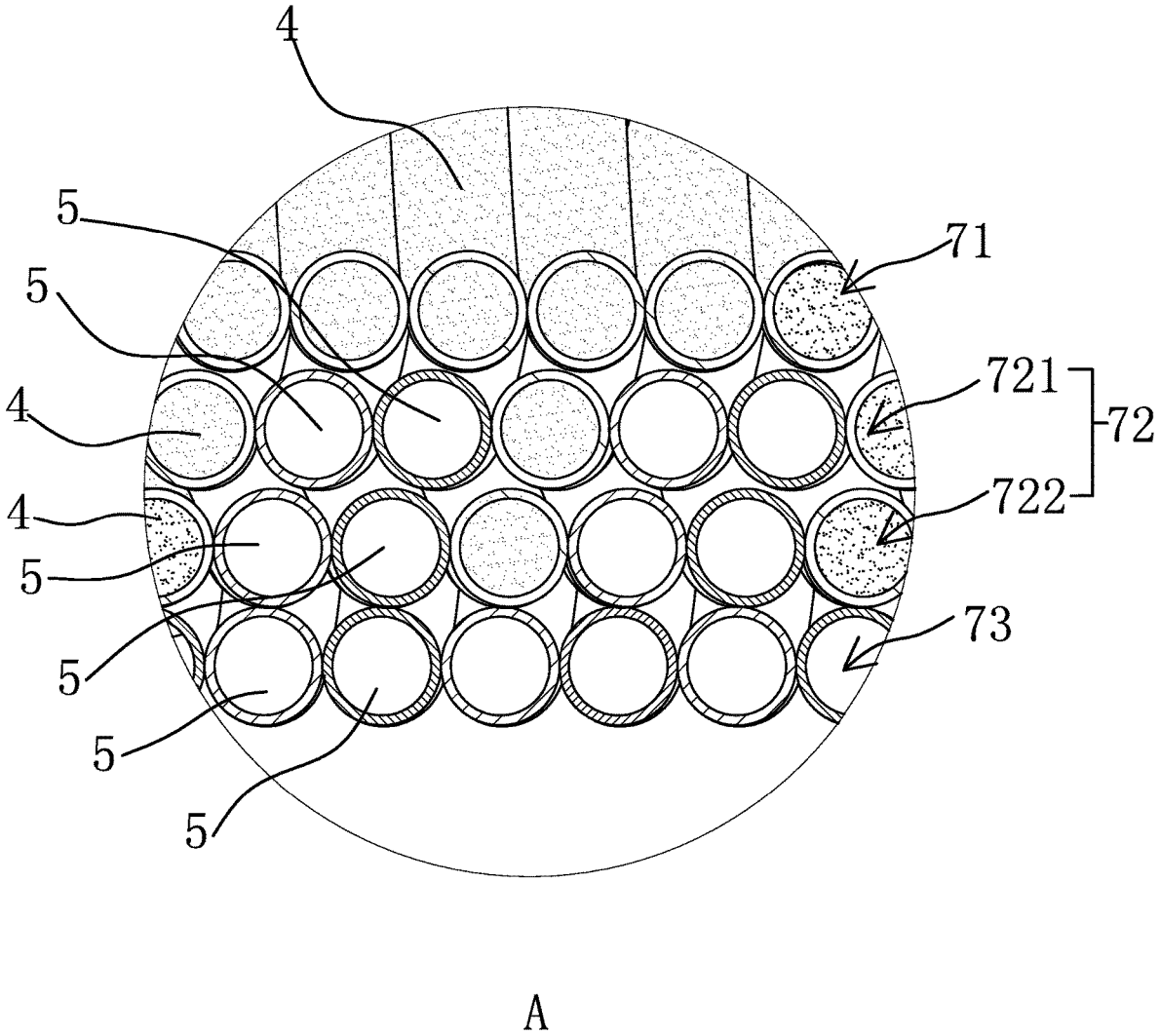
FIG. 3 is a detailed view of Section A in FIG. 2.

As shown in FIG. 1 through FIG. 3, the quick cooler (7) is formed by winding the refrigeration tubes (4) and beer pipes (5) in the present invention in a helical manner, and hence the quick cooler (7) is located in the cold storage chamber (11). The existing draft beer machines generally have a dual cavity structure. The cavity to hold the cask (10) is separated from the cavity used for refrigeration. For example, the refrigeration cavity used for water tank refrigeration is separated from the cavity to hold the cask (10). Therefore, the excessive cooling capacity in the water tank cannot be fully utilized and hence the cooling capacity is wasted. However, in the present invention, by changing the structure, the whole draft beer machine is designed as a single cavity structure. The cask (10) and the quick cooler (7) are all arranged inside the cold storage chamber (11). Cooling capacity which is not fully utilized yet by the quick cooler (7) can disperse to the residual cavity of the cold storage chamber (11), and reduces the overall temperature of the cold storage chamber (11). It can refrigerate the cask (10) placed in the cold storage chamber (11). Specifically, the quick cooler (7) comprises at least one mixing layer (72), which is formed by winding the laterally abutting refrigeration tube (4) and beer pipe (5) in an abreast and helical manner simultaneously. In the same mixing layer (72), adjacent beer pipe (5) and refrigeration tube (4) adhere to each other. With the tight contact, the cooling capacity is transferred between the refrigeration tube (4) and the beer pipe (5) in the form of dry contact cooling. Compared to water cooling, dry contact cooling has an advantage of high efficiency of cooling capacity transfer, and can further expedite the refrigeration process. Both of the quick cooler (7) and the mixing layer (72) may be round or elliptic cylindrical. Both shapes can present smooth flow transport everywhere on the refrigeration tubes (4) and the beer pipes (5). This ensures that the fluid in the beer pipes (5) and the refrigeration tubes (4) flows fluently, can further ensure a uniform distribution of cooling capacity, prevents the tubes from being clogged by ice due to non-uniform local cooling capacity, and is also convenient for the manufacturing. Of course, it is acceptable that the quick cooler (7) has more mixing layers (72), but ensures that each mixing layer (72) is wound with few coils. Namely, it is applicable that the whole quick cooler (7) is in an approximate disk shape. Furthermore, here the two adjacent mixing layers (72) directly adhere, to ensure that cooling capacity is transferred quickly.

As shown in FIG. 2, in this embodiment, the quick cooler (7) is formed by wrapping two cylindrical mixing layers (72), so a cylinder-like cavity is formed inside the innermost mixing layer (721). This cavity is the core of the whole quick cooler (7), and cooling capacity gathering here reaches the peak. In this embodiment, a refrigeration layer (71) is also arranged inside the innermost mixing layer (721). By arranging, inside the innermost mixing layer (721), one refrigeration layer (71) which is formed only by the refrigeration tubes (4), the refrigeration fluid in the refrigeration tubes (4) can fully absorb the cooling capacity inside the cavity, and transfers cooling capacity to beer through the refrigeration fluid, so as to fulfill the purpose of improving the refrigeration efficiency of beer. The refrigeration layer (71) is formed by winding the refrigeration tubes (4) into a round or an elliptic cylindrical shape, in a helical manner, presenting smooth flow transport everywhere on the refrigeration tubes (4). This ensures that the fluid in the refrigeration tubes (4) flows fluently, prevents the tubes from being clogged by ice due to non-uniform local cooling capacity and ensures a uniform distribution of cooling capacity. In this embodiment, the quick cooler (7) is formed by winding one refrigeration tube (4) and two beer pipes (5) (for easy understanding, in the appended drawings, the two beer pipes (5) are displayed with different hatches in order to highlight the quantity). Each beer pipe (5) is successively wound into each mixing layer (72) continuously, so each beer pipe (5) will be gradually refrigerated when passing each mixing layer (72). This ensures a long refrigeration route, and hence improves the refrigeration effect. In addition, the refrigeration layer (71) here and the innermost mixing layer (721) directly adhere to transfer cooling capacity. Of course, the quantity of beer pipes (5) may be 3 or more, and the quantity of refrigeration tubes (4) may not be limited to 1. It is applicable to arrange more refrigeration tubes (4).

As shown in FIG. 3, in the present invention, a beer pipe layer (73) is sleeved over the outside of the outermost mixing layer (722). This can further prevent cooling capacity in its inner mixing layer (72) from dissipating, and can ensure that the refrigeration fluid always has a low temperature, so as to achieve the quick refrigeration of beer. Specifically, all beer pipes (5) are wound into the beer pipe layer (73), which can ensure that the outermost beer pipe layer (73) of the whole quick cooler (7) achieves a good effect of sealing and cooling capacity storage. This can fully take advantage of the residual cooling capacity in the mixing layer (72), prevents too much cooling capacity from dissipating to the outside of the quick cooler (7), and further improves the refrigeration effect. Also, the beer pipe layer (73) is formed by winding the beer pipes (5) into a round or an elliptic cylindrical shape, in a helical manner, so a fluent beer flow in the beer pipes (5) can be ensured. In addition, the beer pipe layer (73) here and the outermost mixing layer (722) directly adhere to transfer cooling capacity.

Furthermore, in this embodiment, the beer pipe (5) of the innermost mixing layer (721) is used to connect to the cask (10), and the beer pipe (5) of the beer pipe layer (73) is connected to the beer tap (6). The refrigeration tube (4) of the outermost mixing layer (722) is connected to the condenser (3), and the refrigeration tube (4) of the refrigeration layer (71) is connected to the compressor (2). The refrigeration fluid which outflows from the condenser (3) has a fairly low initial temperature. Namely, the end connected to the condenser (3) is the inlet end of the refrigeration tube (4). In the present invention, the refrigeration tube (4) in the outermost mixing layer (722) is connected to the condenser (3), ensuring that the temperature in the outermost mixing layer (722) is always fairly low. Namely, the inlet end of the refrigeration fluid in the quick cooler (7) is located in the outermost mixing layer (722), and the outlet end is located in the innermost refrigeration layer (71) of the whole quick cooler (7). Also, the inlet end of beer in the present invention is located in the innermost mixing layer (721), and the outlet end is located in the outermost beer pipe layer (73) of the whole quick cooler (7). Therefore, the outlet end of beer is next to the inlet end of the refrigeration fluid, and the inlet end of beer is next to the outlet end of the refrigeration fluid. Beer and the refrigeration fluid form a relative counter-flow formation, ensuring that the outlet end of beer can always has a fairly low temperature and this further improves the refrigeration efficiency of discharged beer. Of course, with this arrangement, cooling capacity in the deeper refrigeration tube (4) becomes less and less, resulting in a worse refrigeration effect in the deeper interior. However, in this embodiment, an extra one refrigeration layer (71) is arranged inside the innermost mixing layer (721) to ensure an enhanced refrigeration effect.

Figure 4:
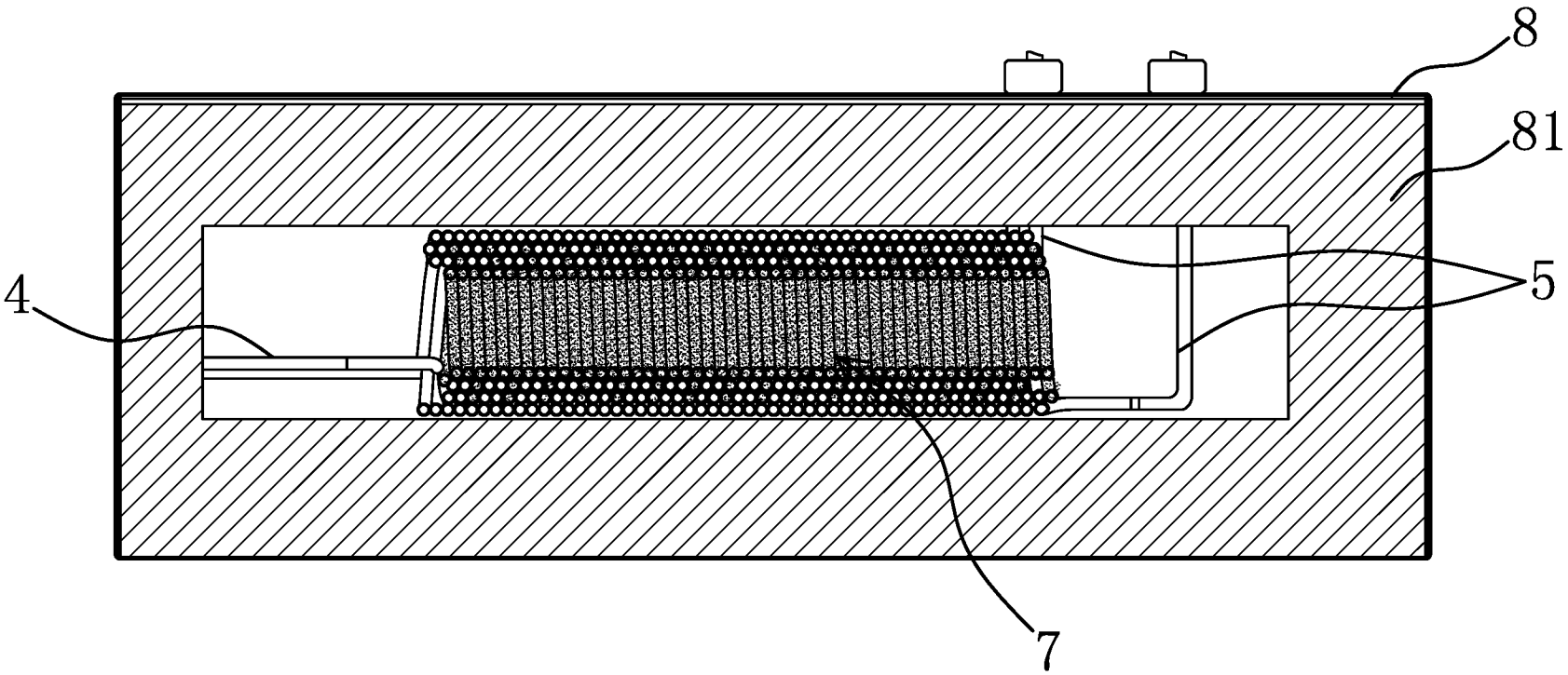
FIG. 4 is a sectional view of one embodiment of the internal structure of the shell.
Figure 5:
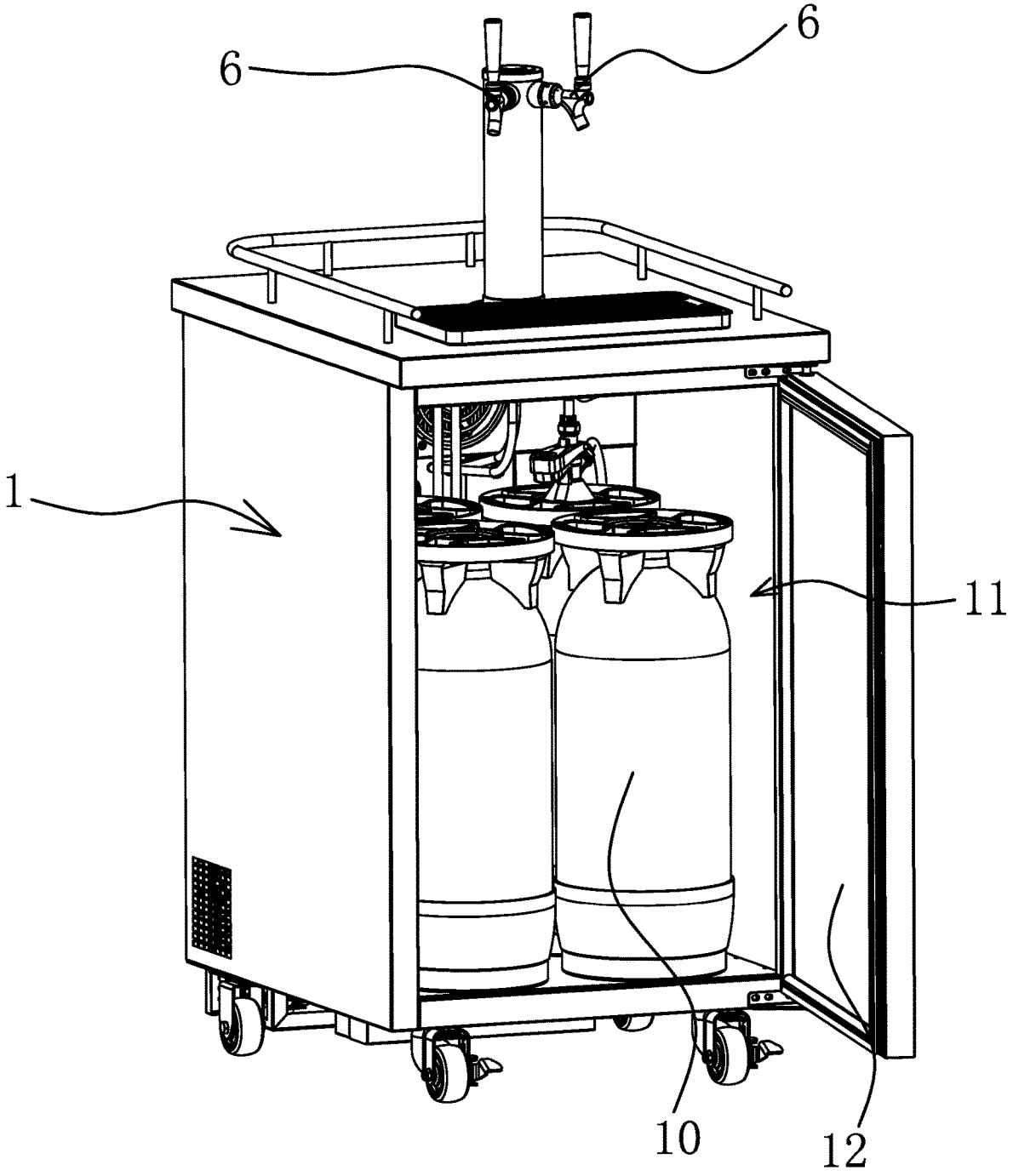
FIG. 5 is a perspective view of the draft beer machine of the First Embodiment where the casks are in place.
Figure 6:
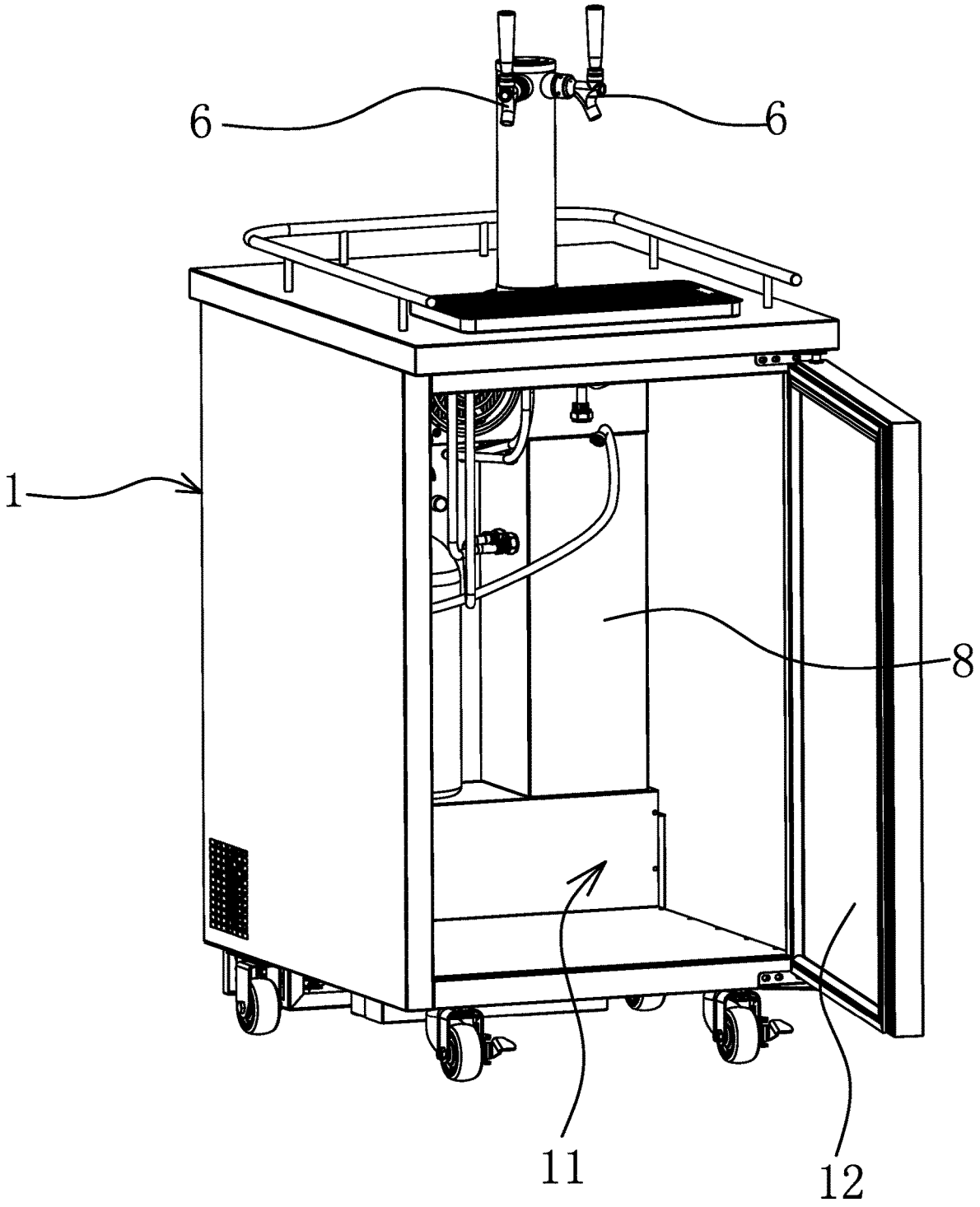
FIG. 6 is a perspective view of the draft beer machine of the First Embodiment where the casks are not placed.
Figure 7:
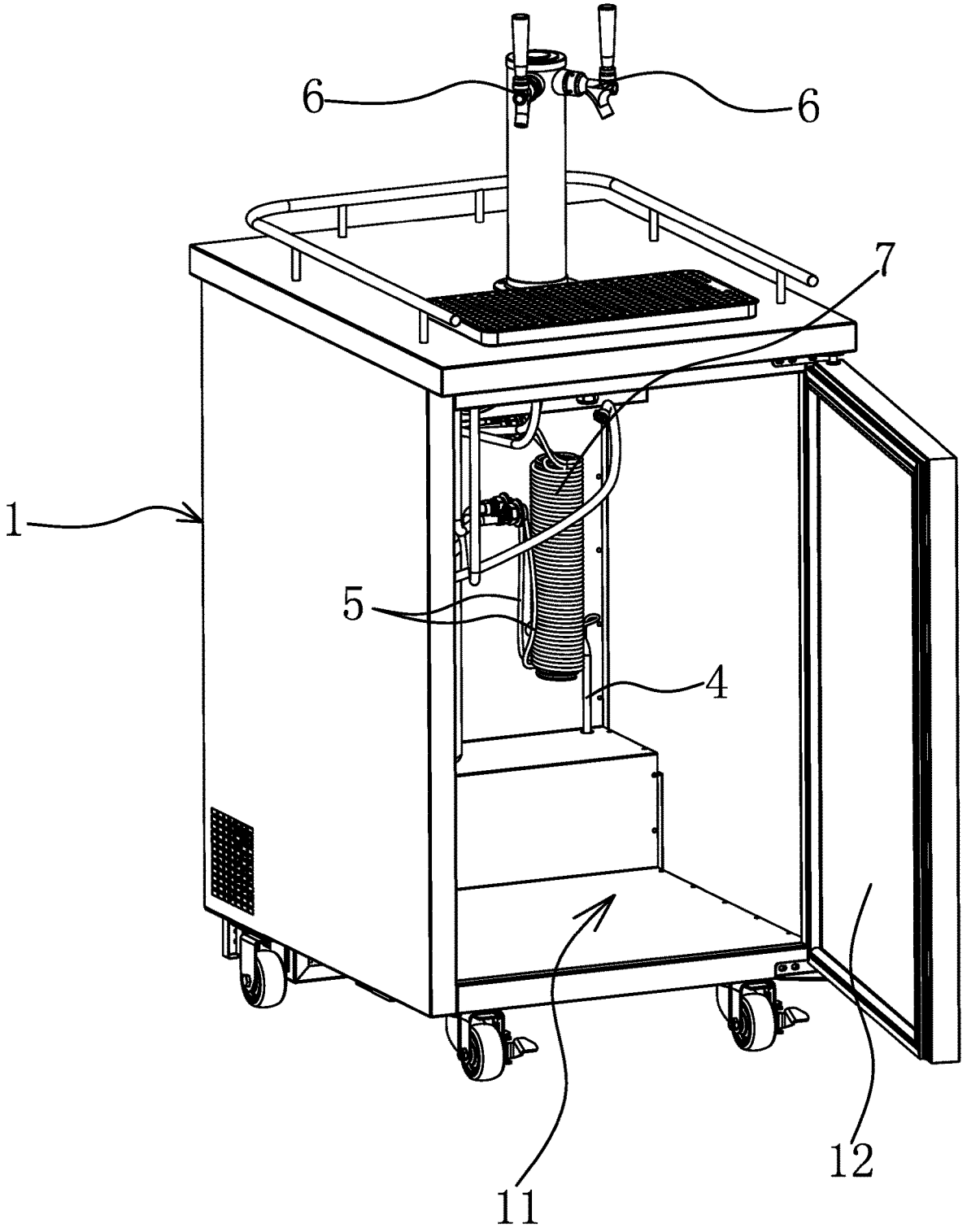
FIG. 7 is a perspective view of FIG. 5 where the shell and insulation layer are removed.
Figure 8:
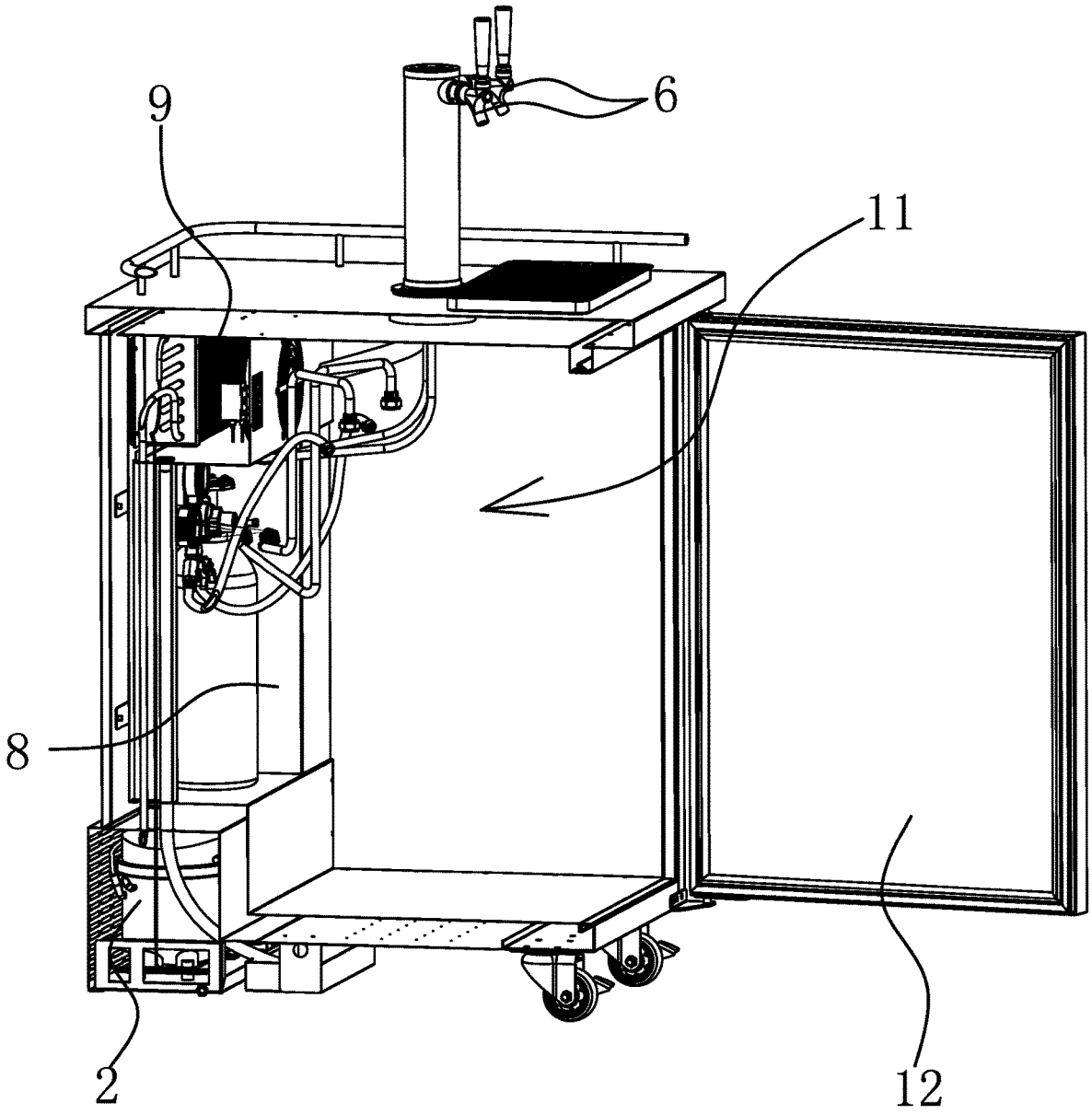
FIG. 8 is a schematic view of the refrigeration circuit of the First Embodiment.
Figure 9:
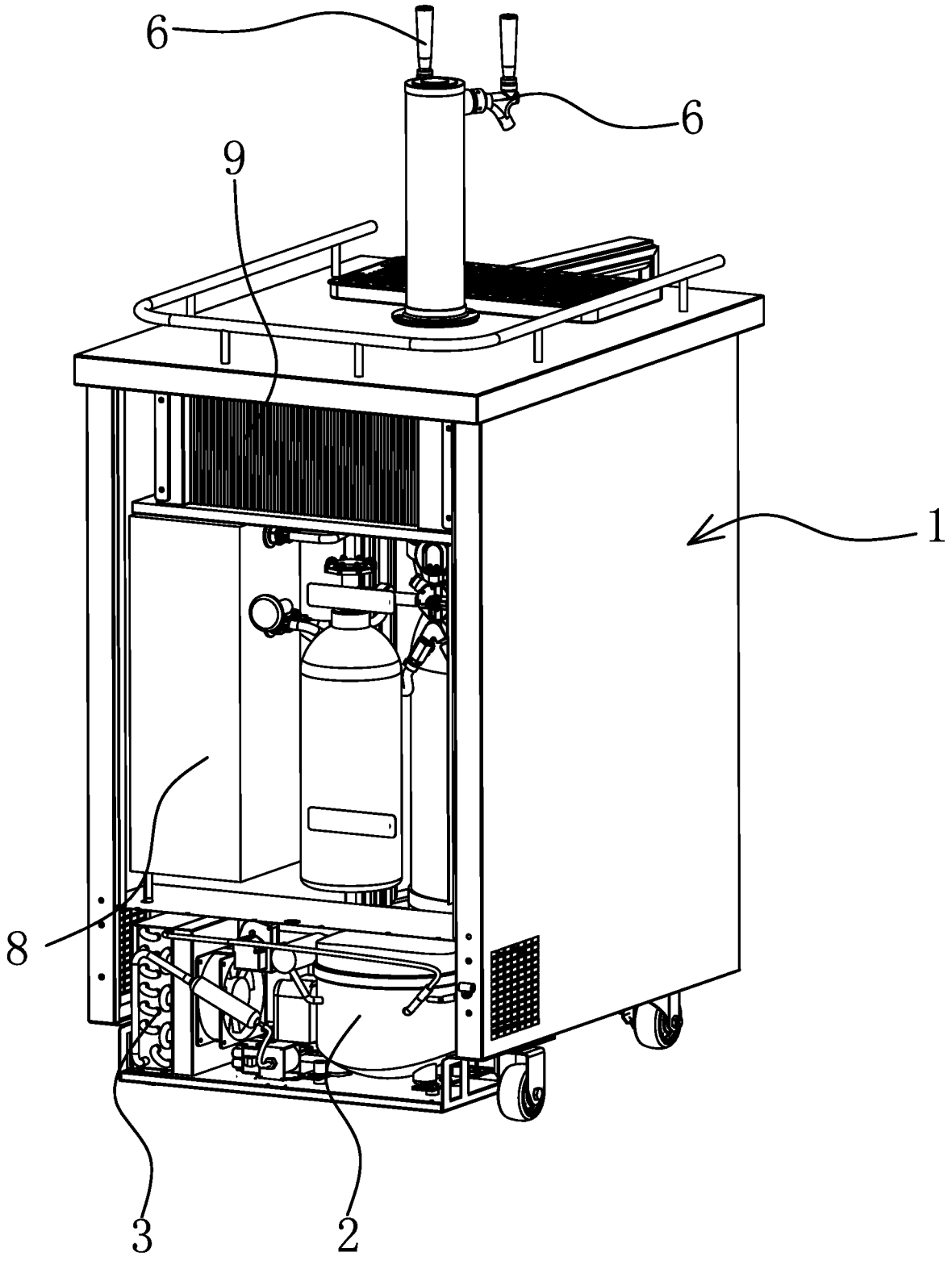
FIG. 9 is a schematic view of FIG. 8 from another perspective.

As shown in FIG. 4, a shell (8) used to accommodate the quick cooler (7) is also arranged outside the quick cooler (7). The quick cooler (7) is located inside the shell (8). By arranging the shell (8) and placing the quick cooler (7) in the shell (8), the dissipation of cooling capacity is further prevented, and it is ensured that much cooling capacity gathers in the shell (8) and gets fully utilized. Moreover, an insulation layer (81) is set up between the quick cooler (7) and the inner wall of the shell (8). The arrangement of the insulation layer (81) can enhance the effect of insulation and cooling capacity storage and prevents cooling capacity from further dissipating, so as to further improve the refrigeration effect.

Second Embodiment

Figure 10:
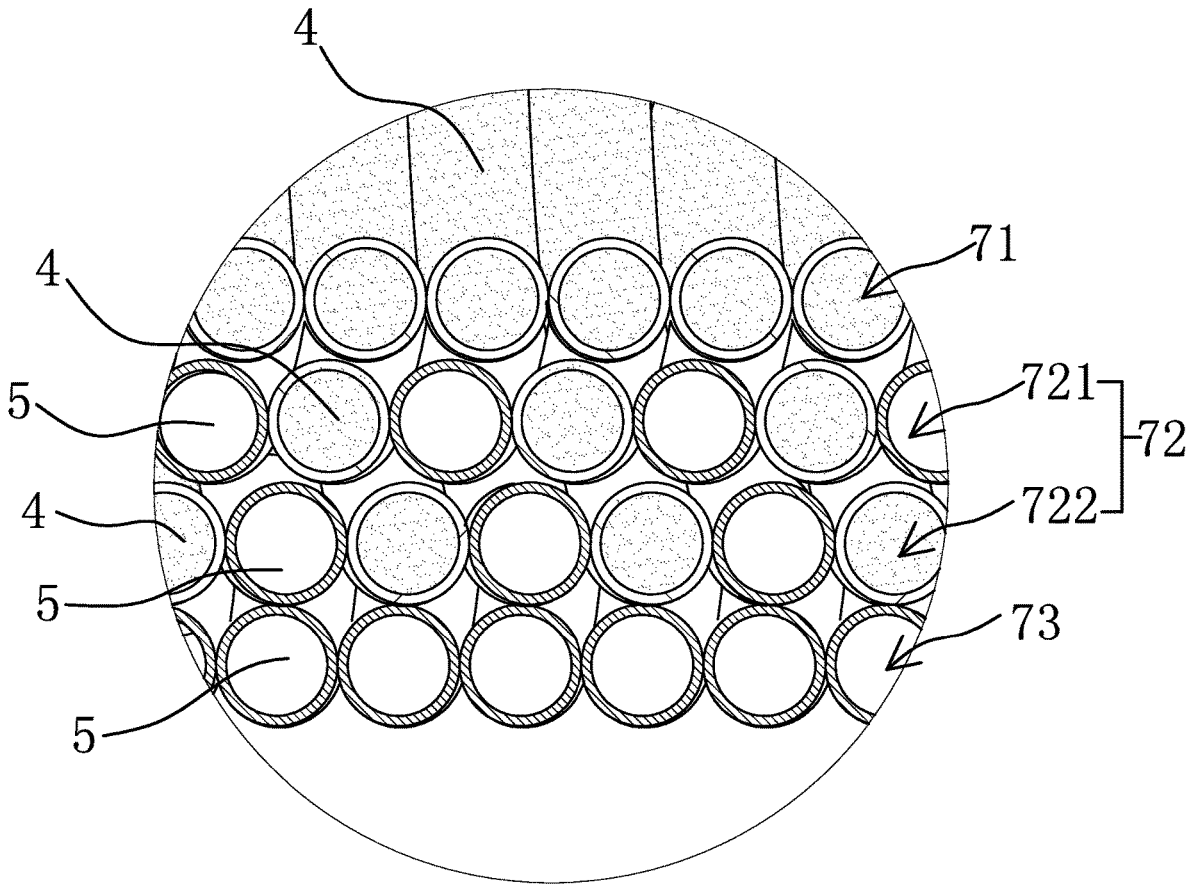
FIG. 10 is a detailed view of the interior of the quick cooler of the Second Embodiment.

The structure and principle of this embodiment is basically the same as that of the first embodiment. The differences are:

As shown in FIG. 10, the quick cooler (7) is formed by winding one refrigeration tube (4) and one beer pipe (5). The refrigeration tube (4) adheres both sides of each beer pipe (5) inside the wound helical coil. The refrigeration effect is better.

Third Embodiment

The structure and principle of this embodiment is basically the same as that of the first embodiment. The differences are:

The two adjacent tube layers do not directly adhere; instead, a thermal conductive medium is filled in between the two layers. The thermal conductive medium is thermal conductive mud. Namely, the thermal conductive mud is filled in between the beer pipe layer (73) and the outermost mixing layer (722), between the adjacent mixing layers (72), and between the innermost mixing layer (721) and the refrigeration layer (71). The thermal conductive mud can be kneaded into various shapes as required, and be filled in between two adjacent tube layers. This allows two tube layers to adhere tightly, reduce the thermal resistance and transfer cooling capacity quickly and effectively to refrigerate beer, so as to improve the refrigeration efficiency of beer. Of course, aluminum powder has a fairly good thermal conductivity and it can effectively transfer cooling capacity, so it is applicable to this situation.

Fourth Embodiment

Figure 11:
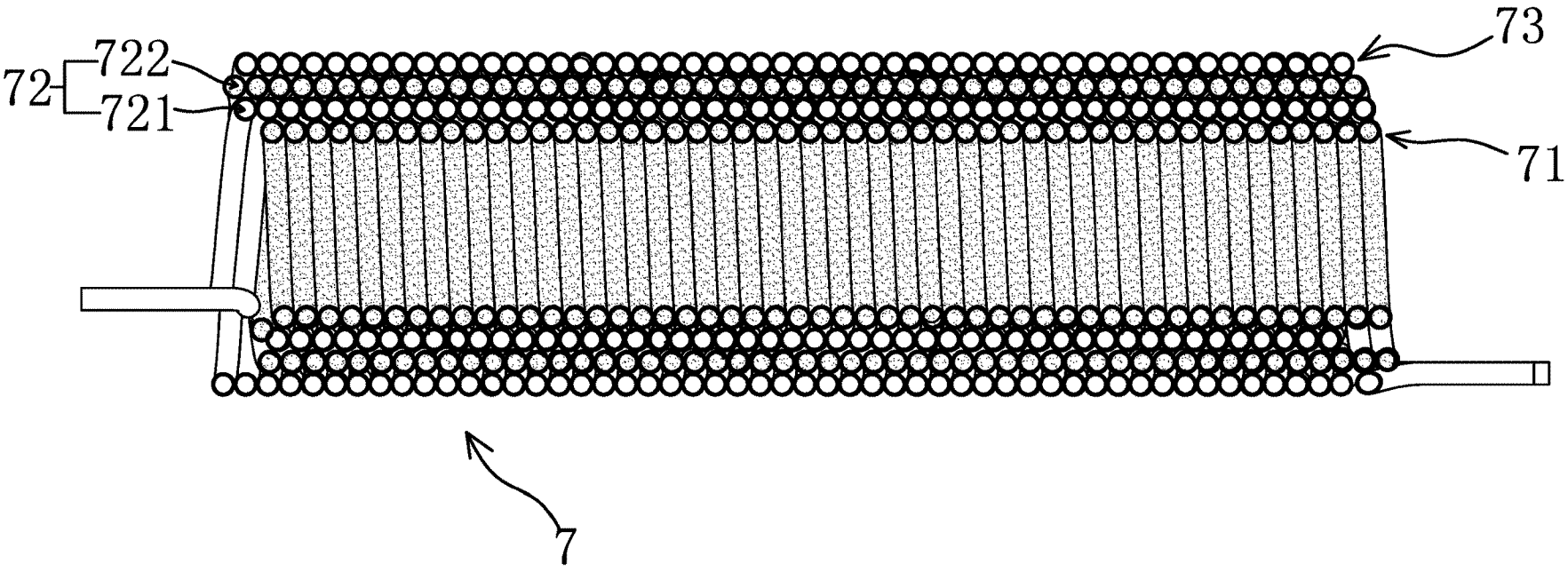
FIG. 11 is a sectional view of the interior of the quick cooler of the Fourth Embodiment.

The structure and principle of this embodiment is basically the same as that of the first embodiment. The differences are:

As shown in FIG. 11, the mixing layer of the quick cooler (7) is formed by winding one above or below abutting refrigeration tube (4) with each beer pipe (5) simultaneously. The refrigeration tube (4) adheres both sides of each beer pipe (5) inside the wound helical coil and the refrigeration tube (4) and the beer pipe (5) is in dislocation arrangement. The refrigeration effect is also better.

The description of the preferred embodiments thereof serves only as an illustration of the scope of the invention. It will be understood by those skilled in the art that various changes or supplements in form and details may be made therein without departing from the scope of the invention as defined by the appended claims.

Although the terms of Cabinet (1), Cold Storage Chamber (11), Door (12), Compressor (2), Condenser (3), Refrigeration Tube (4), Beer Pipe (5), Beer Tap (6), Quick Cooler (7), Refrigeration Layer (71), Mixing Layer (72), Beer Pipe Layer (73), Shell (8), Insulation Layer (81), Evaporator (9), Cask (10), etc. are often used herein, it does not exclude the possibility to use any other terms. Using such terms is only to describe or explain the nature of the present invention more conveniently. Any additional restrictions are contrary to the scope of the present invention.

LIST OF REFERENCE NUMERALS

1 Cabinet
11 Cold Storage Chamber
12 Door
2 Compressor
3 Condenser
4 Refrigeration Tube
5 Beer Pipe
6 Beer Tap
7 Quick Cooler
71 Refrigeration Layer
72 Mixing Layer
721 Innermost Mixing Layer
722 Outermost Mixing Layer
73 Beer Pipe Layer
8 Shell
81 Insulation Layer
9 Evaporator
10 Cask

What is claimed is:

1. A draft beer machine, comprising:

a cabinet;

a refrigeration circuit inside the cabinet, the refrigeration circuit includes a compressor, a condenser, and a refrigeration tube;

a beer pipe arranged inside the cabinet;

a beer tap fixed to an outside of the cabinet; and an outer end of the beer pipe connected to the beer tap;

wherein the refrigeration tube and the beer pipe are wound into a quick cooler of a round or an elliptic cylindrical shape, the refrigeration tube and the beer pipe wound in a helical manner;

wherein the quick cooler comprises at least two mixing layers in a radial direction of the quick cooler, each of the at least two mixing layers is formed into a round or elliptic cylindrical shape by helically winding the refrigeration tube and the beer pipe which are arranged in an abreast manner;

wherein the at least two mixing layers include two adjacent mixing layers, the two adjacent mixing layers abut onto each other in the radial direction of the quick cooler; and wherein in each of the at least two mixing layers, the refrigeration tube and the beer pipe—are arranged in an axial direction of the quick cooler and outer walls of the refrigeration tube and the beer pipe abut onto each other.

2. The draft beer machine as claimed in claim 1 wherein a thermal conductive medium is filled between the two adjacent mixing layers.

3. The draft beer machine as claimed in claim 2 wherein a refrigeration layer is arranged inside an innermost layer of the at least two mixing layers;

wherein the refrigeration layer is formed by winding the refrigeration tube into a round or elliptic cylinder, the refrigeration layer formed in a helical manner; and wherein the refrigeration layer and the innermost layer of the at least two mixing layers abut onto each other, either directly or with a thermal conductive medium filled in between the refrigeration layer and the innermost layer of the at least two mixing layers.

4. The draft beer machine as claimed in claim 3 wherein a beer pipe layer is sleeved over an outside of an outermost layer of the at least two mixing layers;

wherein the beer pipe layer is formed by winding the beer pipe into a round or elliptic cylinder, the beer pipe layer formed in a helical manner; and wherein the beer pipe layer and the outermost layer of the at least two mixing layers abut on each other, either directly or with a thermal conductive medium filled in between the beer pipe layer and the outermost layer of the at least two mixing layers.

5. The draft beer machine as claimed in claim 4 wherein the quick cooler is formed by winding simultaneously the refrigeration tube and the beer pipe which are arranged in a laterally abutting manner.

6. The draft beer machine as claimed in claim 4 wherein the quick cooler is formed by winding simultaneously the refrigeration tube and the beer pipe which are arranged in an above or a below abutting manner.

7. The draft beer machine as claimed in claim 5 wherein the quick cooler is formed by winding the refrigeration tube and at least two beer pipes; or the quick cooler is formed by winding the refrigeration tube and one beer pipe.

8. The draft beer machine as claimed in claim 4 wherein the beer pipe is wound into each of the at least two mixing layers and beer pipe layer continuously, and the refrigeration tube is wound into each of the at least two mixing layers and the refrigeration layer continuously.

9. The draft beer machine as claimed in claim 4 wherein the beer pipe of the innermost layer of the at least two mixing layers is used to connect to a cask;

wherein the beer pipe of the beer pipe layer is connected to the beer tap;

wherein the refrigeration tube of the outermost layer of the at least two mixing layers is connected to the condenser, and the refrigeration tube of the refrigeration layer is connected to the compressor.

10. The draft beer machine as claimed in claim 2 wherein the thermal conductive medium is thermal conductive mud or aluminum powder.

11. The draft beer machine as claimed in claim 1 wherein a shell is arranged outside the quick cooler, the shell used to accommodate the quick cooler;

wherein the quick cooler is located inside the shell; and wherein an insulation layer is set up between the quick cooler and an inner wall of the shell.

12. The draft beer machine as claimed in claim 1 wherein there is a cold storage chamber inside the cabinet, the cold storage chamber used to hold a cask;

wherein the cold storage chamber has a single chamber structure; and wherein the quick cooler is located in the cold storage chamber.

13. The draft beer machine as claimed in claim 1 wherein the quick cooler is formed by winding the refrigeration tube and at least two beer pipes or the quick cooler is formed by winding the refrigeration tube and one beer pipe;

wherein the beer pipe is wound into each of the at least two mixing layers continuously.

14. The draft beer machine as claimed in claim 1 wherein a refrigeration circuit also includes an evaporator, the evaporator and the quick cooler are series connected or parallel connected.

15. A quick cooler, comprising:

a refrigeration tube, conducting refrigerant from a refrigeration circuit; and at least one beer pipe, each of the at least one beer pipe having an outer end and an inner end to conduct beer or beverage to a tap;

wherein the refrigeration tube and the at least one beer pipe are wound into a quick cooler of a round or an elliptic cylindrical shape, the refrigeration tube and the at least one beer pipe wound in a helical manner;

wherein the quick cooler comprises at least two mixing layers in a radial direction of the quick cooler, each of the at least two mixing layers is formed into a round or elliptic cylindrical shape by helically winding the refrigeration tube and the at least one beer pipe which are arranged in an abreast manner;

wherein the at least two mixing layers include at least two adjacent mixing layers, the at least two adjacent mixing layers abut onto each other in the radial direction of the quick cooler; and wherein in each of the at least two mixing layers, the at least one beer pipe and the refrigeration tube are arranged in an axial direction of the quick cooler and outer walls of the refrigeration tube and the at least one beer pipe abut onto each other.

16. The quick cooler as claimed in claim 15 wherein a thermal conductive medium is filled between the at least two adjacent mixing layers.

17. The quick cooler as claimed in claim 16 wherein a refrigeration layer is arranged inside an innermost layer of the at least two mixing layers;

wherein the refrigeration layer is formed by winding the refrigeration tube into a round or elliptic cylinder, the refrigeration layer formed in a helical manner; and wherein the refrigeration layer and the innermost layer of the at least two mixing layers abut onto each other, either directly or with a thermal conductive medium filled in between the refrigeration layer and the innermost layer of the at least two mixing layers.

18. The quick cooler as claimed in claim 17 wherein a beer pipe layer is sleeved over an outside of an outermost layer of the at least two mixing layers; wherein the beer pipe layer is formed by winding the at least one beer pipe into a round or elliptic cylinder, the beer pipe layer formed in a helical manner; and wherein the beer pipe layer and the outermost layer of the at least two mixing layers abut on each other, either directly or with a thermal conductive medium filled in between the beer pipe layer and the outermost layer of the at least two mixing layers.

19. The quick cooler as claimed in claim 18 wherein the quick cooler is formed by winding simultaneously the refrigeration tube and the at least one beer pipe which are arranged in a laterally abutting manner or in an above or below abutting manner.

20. The quick cooler as claimed in claim 19 wherein the quick cooler is formed by winding the refrigeration tube and a first beer pipe of the at least one beer pipe, or the quick cooler is formed by winding the refrigeration tube, the first beer pipe, and a second beer pipe of the at least one beer pipe;

the first beer pipe is wound into each mixing layer of the at least two mixing layers and the beer pipe layer continuously, and the refrigeration tube is wound into each of the at least two mixing layers and the refrigeration layer continuously.

* * * * *